US009212791B2

(12) United States Patent
Kim et al.

(10) Patent No.: US 9,212,791 B2
(45) Date of Patent: Dec. 15, 2015

(54) BULB-TYPE LED LIGHTING APPARATUS

(71) Applicants: Hwa Ja Kim, Gyeonggi-do (KR); Soon Dong Kang, Gyeonggi-do (KR)

(72) Inventors: Hwa Ja Kim, Gyeonggi-do (KR); Soon Dong Kang, Gyeonggi-do (KR)

(73) Assignee: Hwa Ja Kim, Gyeonggi-Do (KR)

( * ) Notice: Subject to any disclaimer, the term of this patent is extended or adjusted under 35 U.S.C. 154(b) by 0 days.

(21) Appl. No.: 14/390,568

(22) PCT Filed: Oct. 8, 2012

(86) PCT No.: PCT/KR2012/008118
§ 371 (c)(1),
(2) Date: Oct. 3, 2014

(87) PCT Pub. No.: WO2013/151219
PCT Pub. Date: Oct. 10, 2013

(65) Prior Publication Data

US 2015/0092404 A1 Apr. 2, 2015

(30) Foreign Application Priority Data

Apr. 3, 2012 (KR) ..... 10-2012-0034426

(51) Int. Cl.
*F21V 29/00* (2015.01)
*F21K 99/00* (2010.01)
(Continued)

(52) U.S. Cl.
CPC ..... *F21K 9/1355* (2013.01); *F21K 9/135* (2013.01); *F21V 19/0045* (2013.01); *F21V 19/045* (2013.01); *F21V 29/2206* (2013.01); *F21V 29/2293* (2013.01); *F21V 29/26* (2013.01); *F21V 29/506* (2015.01); *F21V 29/74* (2015.01); *F21V 29/763* (2015.01); *F21V 29/83* (2015.01);
(Continued)

(58) Field of Classification Search
CPC ..... F21V 29/00; F21V 29/004; F21V 29/006; F21V 29/2212; F21Y 2101/02; H01L 33/64
USPC ..... 362/294, 373, 249.02, 227
See application file for complete search history.

(56) References Cited

U.S. PATENT DOCUMENTS

2011/0204790 A1* 8/2011 Arik et al. ..... 315/113
2012/0106140 A1* 5/2012 Sun et al. ..... 362/158
(Continued)

FOREIGN PATENT DOCUMENTS

JP 2008-243780 10/2008
JP 2010-135181 6/2010
(Continued)

*Primary Examiner* — Ali Alavi
(74) *Attorney, Agent, or Firm* — Jordan and Hamburg LLP

(57) ABSTRACT

A bulb-type LED lighting apparatus, including: a base unit; a heat dissipating space retaining unit; a cooling block connected to the heat dissipating space retaining unit and having heat pipe fitting holes and heat dissipating fins; first and second LED circuit boards having LED modules; a heat dissipating frame including heat exchanging plates, clip parts formed on cooling fins of the heat exchanging plates so as to hold heat pipes, cover locking slits for locking protective covers, and a circuit board seat for seating the first LED circuit board; a connection plate unit including pipe fitting slots, cover locking slits for fitting the protective covers, and shoulders for supporting the protective covers; and convective circulation passages defined between the heat exchanging plates so as to allow air to circulate between the heat exchanging plates and realize circulation of air between the inside and outside of the heat dissipating frame therethrough.

6 Claims, 12 Drawing Sheets

(51) Int. Cl.

| | |
|---|---|
| ***F21V 19/00*** | (2006.01) |
| ***F21V 19/04*** | (2006.01) |
| ***F21V 29/506*** | (2015.01) |
| ***F21V 29/74*** | (2015.01) |
| ***F21V 29/76*** | (2015.01) |
| ***F21V 29/83*** | (2015.01) |
| *F21Y 101/02* | (2006.01) |
| *F21Y 111/00* | (2006.01) |

(52) U.S. Cl.
CPC ..... *F21Y 2101/02* (2013.01); *F21Y 2111/005* (2013.01)

(56) References Cited

U.S. PATENT DOCUMENTS

| | | | | |
|---|---|---|---|---|
| 2013/0020462 | A1 | 1/2013 | Kim | |
| 2013/0176724 | A1* | 7/2013 | Yang et al. | 362/231 |
| 2014/0226332 | A1* | 8/2014 | Chen | 362/249.02 |
| 2015/0092404 | A1* | 4/2015 | Kim et al. | 362/227 |

FOREIGN PATENT DOCUMENTS

| | | |
|---|---|---|
| KR | 10-2010-0132213 | 12/2010 |
| KR | 10-2011-0108269 | 10/2011 |
| KR | 10-1106225 | 1/2012 |

* cited by examiner

BULB-TYPE LED LIGHTING APPARATUS

BACKGROUND OF THE INVENTION

The present invention relates, in general, to a bulb-type LED lighting apparatus and, more particularly, to a bulb-type LED lighting apparatus that can remove heat accumulated in a space defined within a heat dissipating frame by dissipating heat upward, downward, leftward and rightward and can remove heat of the heat dissipating frame using a cooling module, thereby maximizing cooling efficiency and realizing an improvement in the expected life span and operational reliability of products.

Generally, light emitting diodes (LED) are widely used as efficient light sources in billboards, signboards, lighting apparatuses, etc. because LEDs have small sizes and long life spans, and use small amounts of electricity due to their characteristic of directly converting electric energy into light energy, and realize improved optical efficiencies compared to conventional light sources.

Further, the LEDs may be semi-permanently used due to their electrical efficiency and power saving effects, so such LEDs can realize improved durability of products. Further, LED lighting apparatuses may be configured to illuminate using a plurality of high power white LEDs, so the LED lighting apparatuses using the high power white LEDs are advantageous in that the intensity of illumination of the LED lighting apparatuses can be variously controlled by changing the number of high power white LEDs and by controlling the electric currents supplied to the LEDs, thereby realizing greatly improved marketability and operational reliability of products.

However, the LEDs typically generate a large amount of heat due to high electric current passing through their chips to produce high luminance, so LEDs are problematic in that the optical characteristics of LEDs under high temperatures may deteriorate. Thus, to constantly retain predetermined optical characteristics of LEDs, it is required to efficiently dissipate heat generated from the LEDs. When inefficient dissipation of heat generated from LEDs occurs, the optical characteristics and the expected life spans of the LEDs may be reduced. Accordingly, it is required to efficiently dissipate internal heat generated from both LEDs and LED circuit boards to which the LEDs are mounted.

To this end, Korean Patent Application Publication No. 10-2011-0085117 proposes a bulb-type LED lighting apparatus. As shown in FIG. 1*a* and FIG. 1*b* of the accompanying drawings, the bulb-type LED lighting apparatus includes LED circuit boards 10 having LEDs 11 mounted to a surface of each of the LED circuit boards 10. The LED lighting apparatus further includes a heat dissipating plate 20 and a heat dissipating unit 30 made of metal (for example, aluminum (Al)). Here, the LED circuit boards 10 are held in the heat dissipating unit 30 and the heat dissipating plate 20 is placed below the LED circuit boards 10.

Here, the heat dissipating unit 30 is shaped as a polygonal container, with inside and outside heat dissipating fins 33 and 34 formed inside and outside a polygonal heat dissipating frame 32 constituting the heat dissipating unit 30. Cover locking slits for holding protective covers 38 are formed along the outside heat dissipating fins 34, and circuit board seats 35 are formed on outside flat surfaces of the polygonal heat dissipating frame 32, so the LED circuit boards 10 can be seated on the respective circuit board seats 35.

Further, a connection cap 60 and a converter PCB 70 having respective air passing holes 61 and 71 are installed above the heat dissipating unit 30 at locations inside a base unit 40 connected to an external electric power source. To dissipate heat from the inside of the base unit 40 to the outside, air passing slits 42 are formed on the base unit 40.

In the conventional bulb-type LED lighting apparatus having the above-mentioned construction, the heat dissipating frame 32 of the heat dissipating unit 30 is formed as a single body having a hexagonal cross-section. Here, the sidewall of the heat dissipating frame 32 is closed, and the interior of the heat dissipating frame 32 communicates with the outside only via the air passing holes of the heat dissipating plate 20 installed in the lower end of the heat dissipating frame 32. Thus, although ambient cold air is introduced into the interior of the heat dissipating frame 32 via the air passing holes of the heat dissipating plate 20, the LED lighting apparatus may fail to efficiently dissipate heat from the interior of the heat dissipating frame 32 to the outside, so the LED lighting apparatus may not be efficiently cooled. Further, although heat dissipating plates are installed in the upper and lower ends of the heat dissipating frame 32 having the closed sidewall, the heat dissipating plates may stop the convective flows of air, so the LED lighting apparatus is problematic in that the interior of the heat dissipating frame 32 may reach a temperature of about 90° C.

Accordingly, the above-mentioned LED lighting apparatus cannot efficiently dissipate internal heat of the heat dissipating frame to the outside, and the heat dissipating function of the air passing holes fails to realize desired heat dissipating effects, thereby reducing the expected life span of the LED lighting apparatus.

SUMMARY OF THE INVENTION

Accordingly, the present invention has been made keeping in mind the above problems occurring in the prior art, and an object of the present invention is to provide a bulb-type LED lighting apparatus, in which the structure of cooling fins provided inside the LED lighting apparatus is designed to perform a collateral function as a holding means for heat pipes, thereby realizing an efficient heat exchanging effect, and in which a heat dissipating frame is formed by assembling a plurality of heat exchanging plates, with convective circulation passages defined between the heat exchanging plates, thereby allowing air to circulate convectively between the heat exchanging plates of the heat dissipating frame and realizing efficient circulation of air between the inside and outside of the heat dissipating frame through the convective circulation passages, so the present invention can greatly increase cooling efficiency and can realize an improvement in the expected life span and operational reliability of products.

In order to accomplish the above object, the present invention provides a bulb-type LED lighting apparatus, including: a base unit in which a screw base is integrated with a housing having a plurality of heat dissipating slits; a heat dissipating space retaining unit in which a spacer is integrated with a surface of a plate detachably mounted to the housing, with a plurality of spacer locking holes formed through the heat dissipating space retaining unit; a cooling block connected to the heat dissipating space retaining unit and having connection holes and heat pipe fitting holes, with an air exhausting through hole formed through a center of the cooling block and a plurality of heat dissipating fins integrated with the cooling block; a first LED circuit board having LED modules; a heat dissipating frame including: heat exchanging plates arranged at spaced positions to form a cylindrical arrangement; clip parts formed on ends of cooling fins integrated with the heat exchanging plates; screw locking holes formed on opposite side edges of each of the heat exchanging plates on one side of the heat exchanging plate on which the cooling fins are formed, so locking screws passing through the heat dissipating space retaining unit are tightened to the screw locking holes; cover locking slits for locking a protective cover, the cover locking slits being formed on the opposite side edges of each of the heat exchanging places on another side of the heat exchanging plate opposite to the cooling fins; and a circuit board seat formed on an outside surface of each of the heat exchanging plates at a position between the cover locking slits so that the first LED circuit board is removably held in the circuit board seat; a connection plate unit comprising a connection plate body, the connection plate body including: pipe fitting slots; a central locking through hole formed through a center of the connection plate body; connection through holes formed through the connection plate body such that the connection through holes are aligned with the screw locking holes of the heat dissipating frame; cover locking slits for fitting the protective covers; and shoulders for supporting the protective covers; a second LED circuit board having a locking through hole aligned with the central locking through hole of the connection plate unit, with LED modules mounted to a surface of the second LED circuit board; and convective circulation passages defined between the heat exchanging plates of the heat dissipating frame so as to allow air to circulate between the heat exchanging plates and realize circulation of air between inside and outside of the heat dissipating frame through the convective circulation passages.

A heat dissipating space may be defined between the heat dissipating space retaining unit and the cooling block so as to dissipate internal heat to outside.

The shoulders of the connection plate unit may further include cover fitting slits for holding the protective covers.

Shoulders may extend downward from lower ends of the respective cooling fins of the cooling block, so a length of the cooling fins is increased and an upper end of the heat dissipating frame is fitted inside a skirt formed by the shoulders of the cooling fins.

The bulb-type LED lighting apparatus may further include: heat pipes of which upper and lower ends are held by the heat pipe fitting holes of the cooling block and the pipe fitting slots of the connection plate unit, and middle portions are held by the clip parts of the heat dissipating frame, so the heat pipes perform heat exchanging.

The heat pipes may be installed such that the upper ends of the heat pipes protrude into a heat dissipating space that is defined between the heat dissipating space retaining unit and the cooling block so as to dissipate internal heat to outside.

According to the present invention, the bulb-type LED lighting apparatus of the present invention is configured in such a way that the structure of cooling fins provided inside the LED lighting apparatus is changed to collaterally function as holding means for holding heat pipes, thereby realizing an efficient heat exchanging operation, and in which a heat dissipating frame is formed by assembling a plurality of heat exchanging plates, with convective circulation passages defined between the heat exchanging plates, thereby allowing air to circulate convectively between the heat exchanging plates of the heat dissipating frame and realizing efficient circulation of air between the inside and outside of the heat dissipating frame through the convective circulation passages, so the present invention can greatly increase cooling efficiency and can realize an improvement in the expected life span and operational reliability of products.

DETAILED DESCRIPTION OF THE INVENTION

Hereinbelow, exemplary embodiments of the present invention will be described in detail with reference to the accompanying drawings.

Figure 1A:
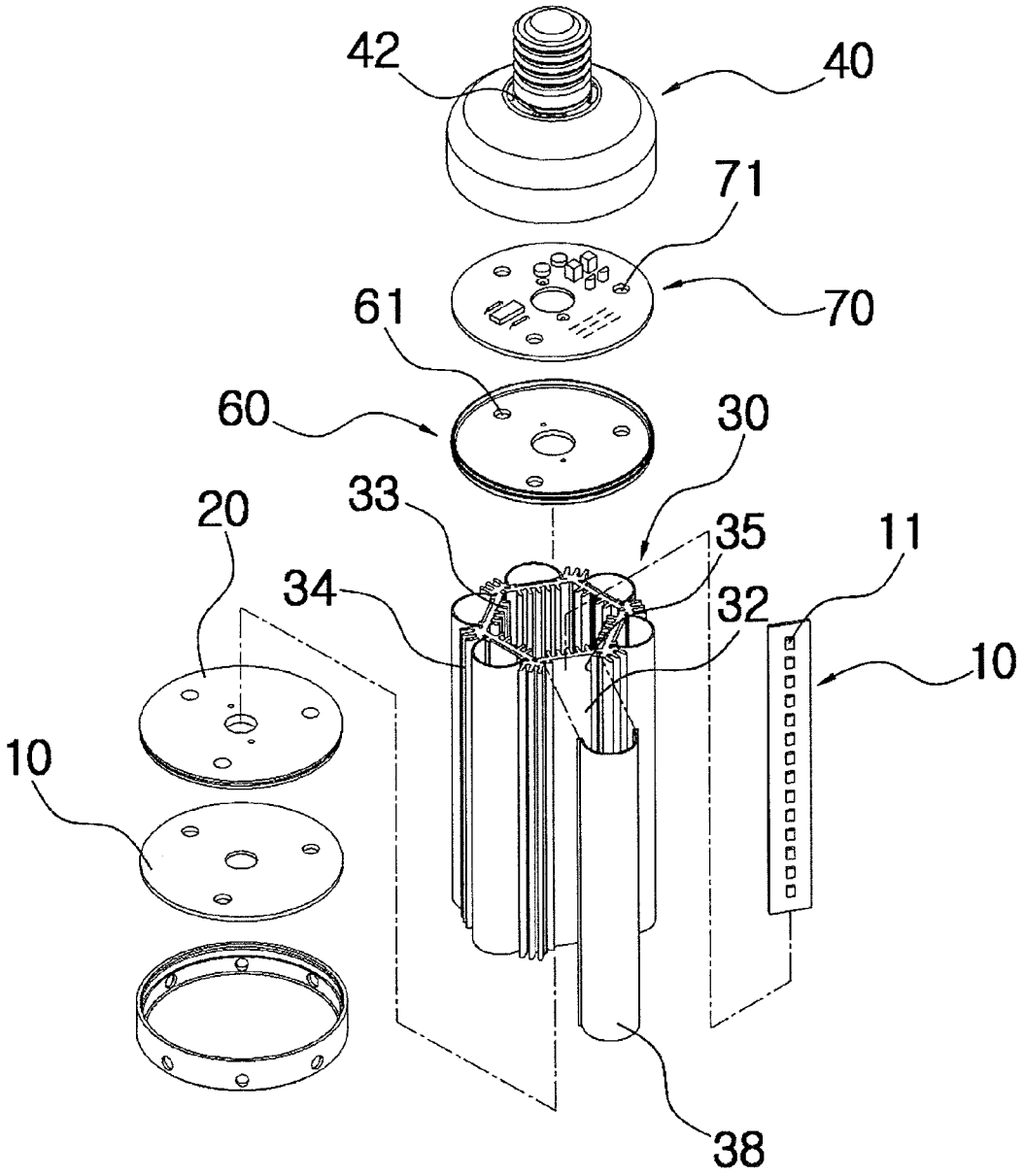
FIG. 1*a* is a perspective view illustrating the construction of a conventional bulb-type LED lighting apparatus.
Figure 1B:
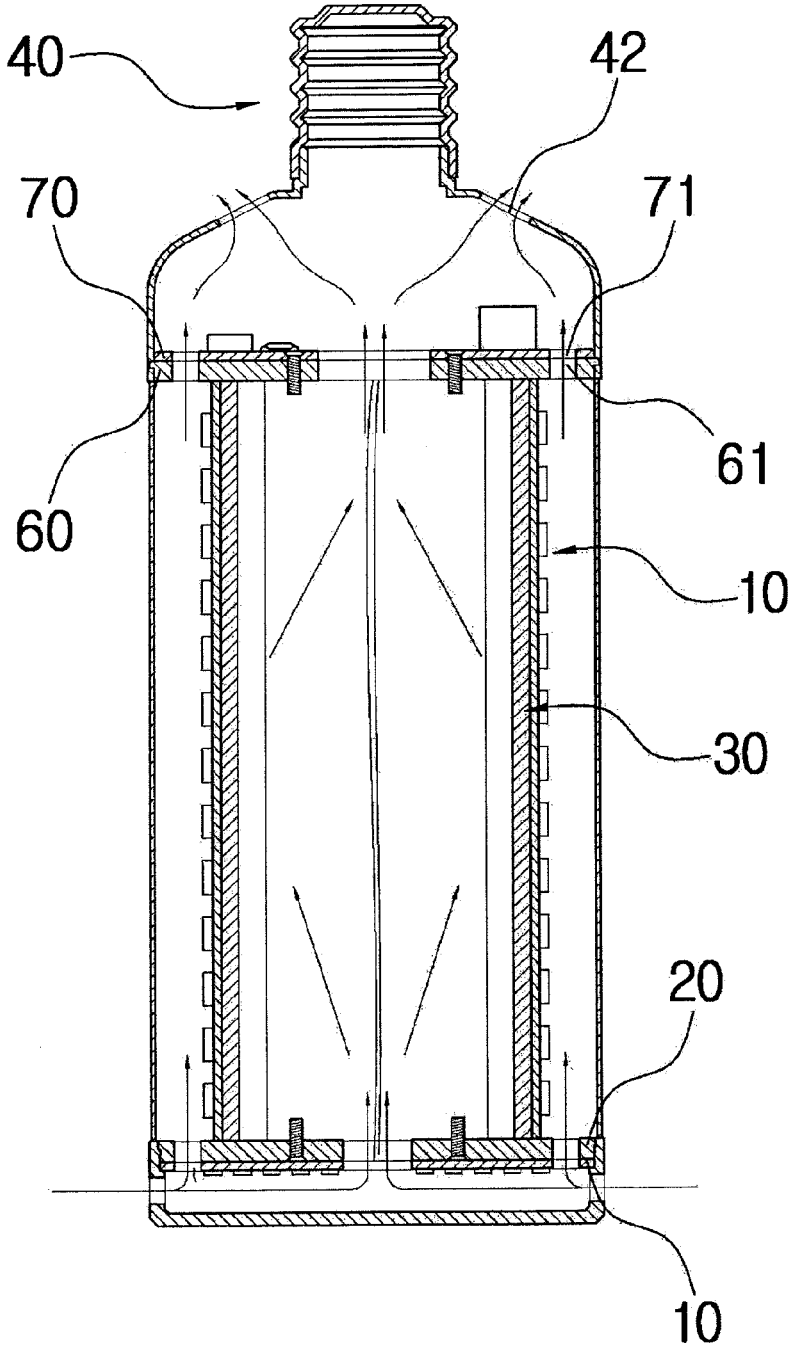
FIG. 1*b* is a sectional view illustrating the construction of the conventional bulb-type LED lighting apparatus.
Figure 2A:
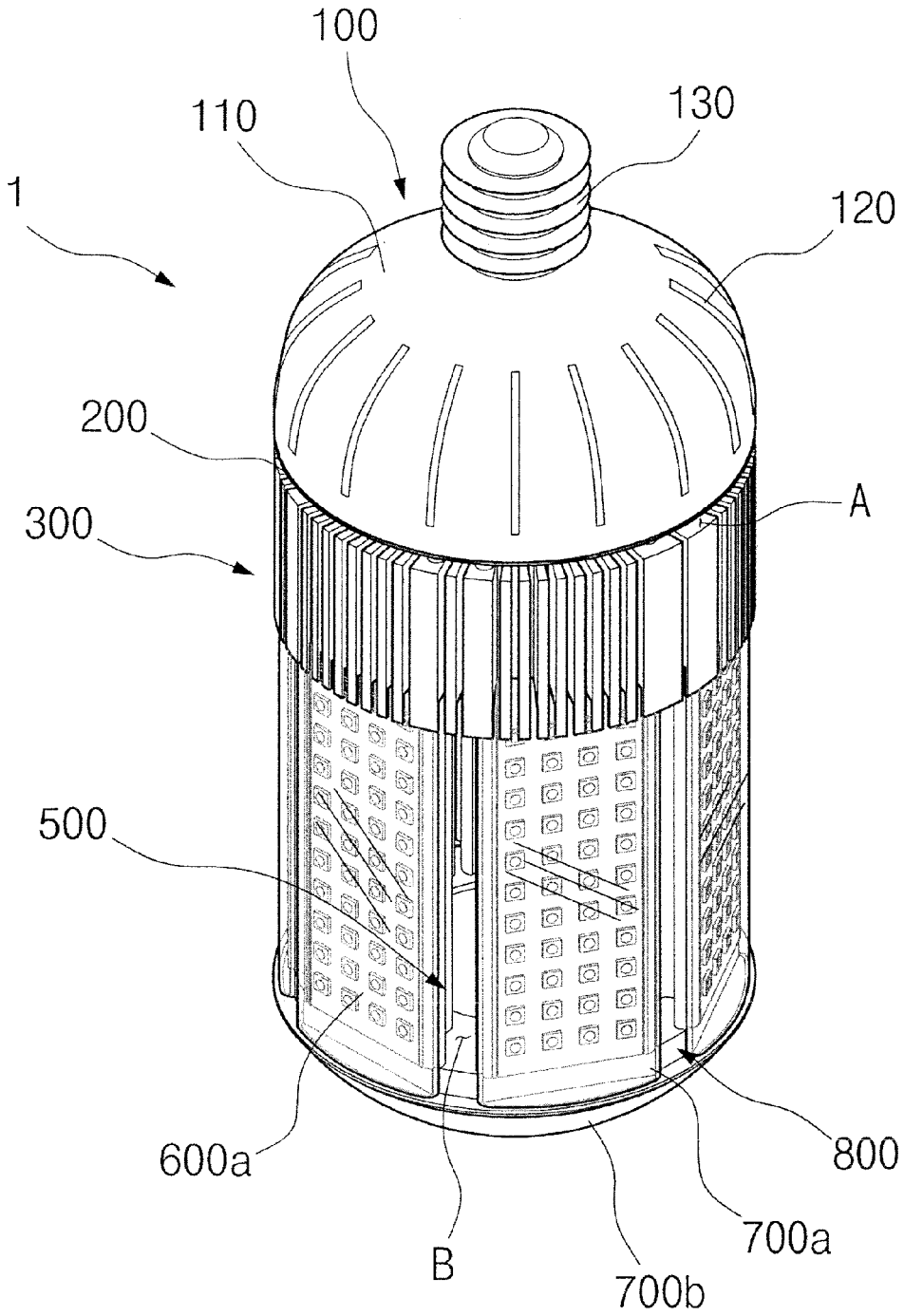
FIG. 2*a* is a perspective view illustrating the construction of a bulb-type LED lighting apparatus embodied using the technology of the present invention.
Figure 2B:
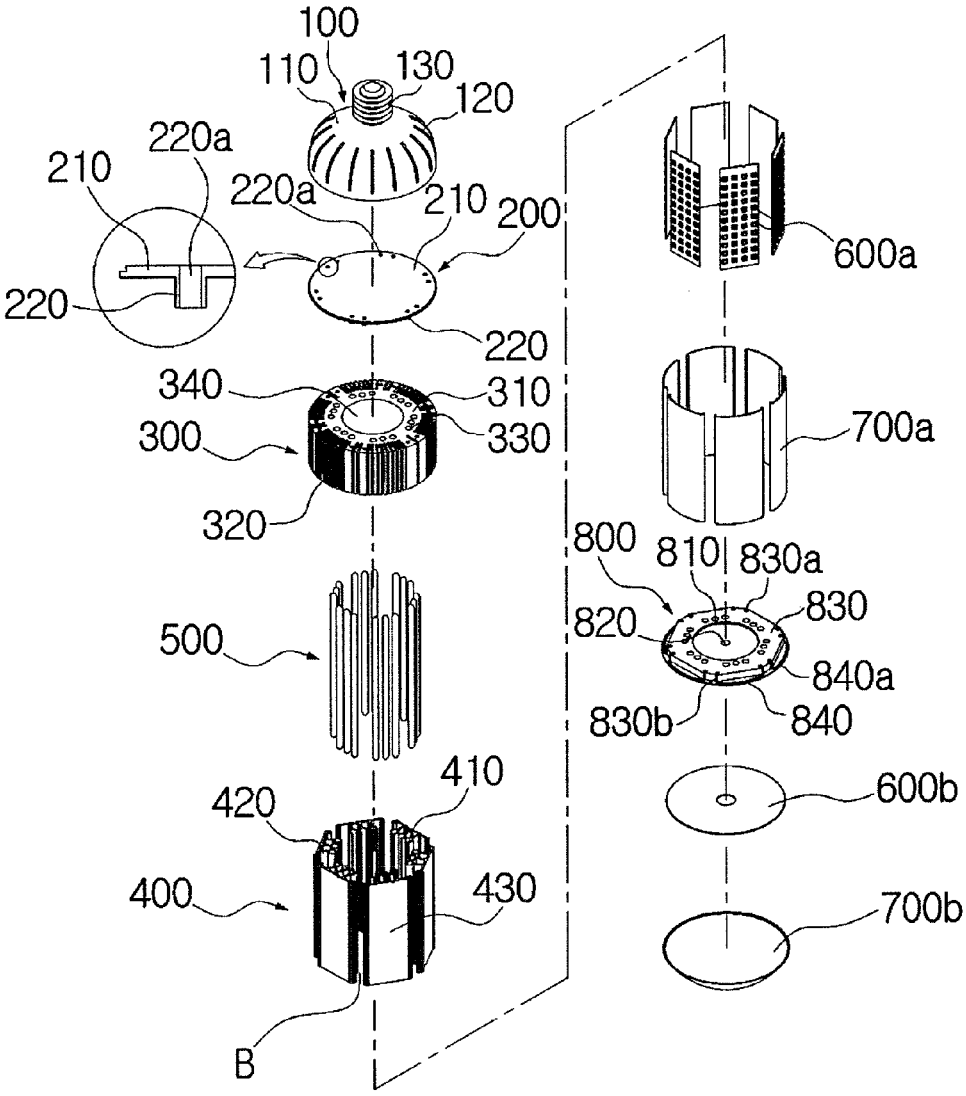
FIG. 2*b* is an exploded perspective view illustrating the construction of the bulb-type LED lighting apparatus embodied using the technology of the present invention.
Figure 3:
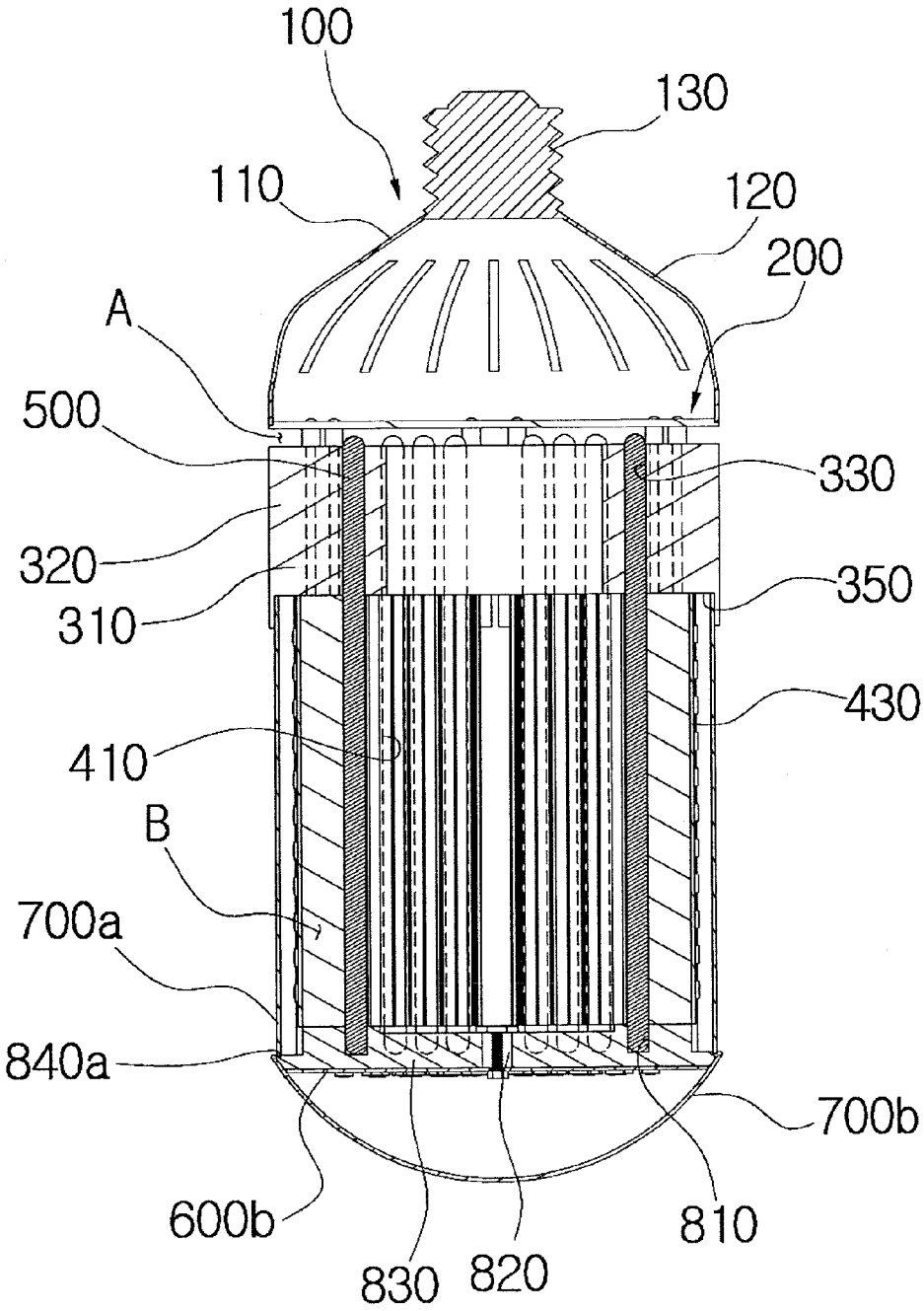
FIG. 3 is a longitudinal sectional view illustrating the construction of the bulb-type LED lighting apparatus embodied using the technology of the present invention.
Figure 4:
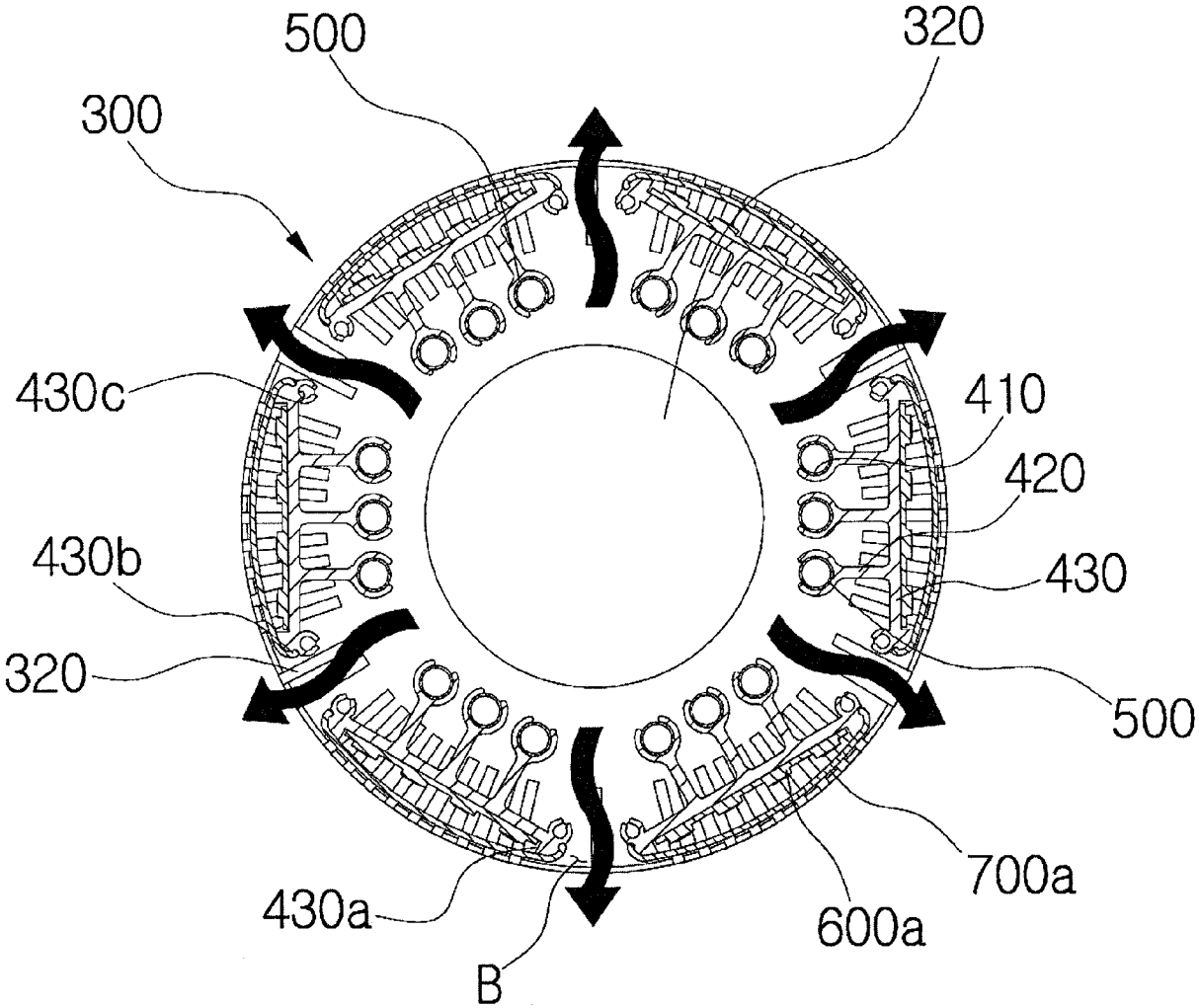
FIG. 4 is a cross sectional view illustrating the installation structure of a heat dissipating frame, which is an important element of the present invention.
Figure 5:
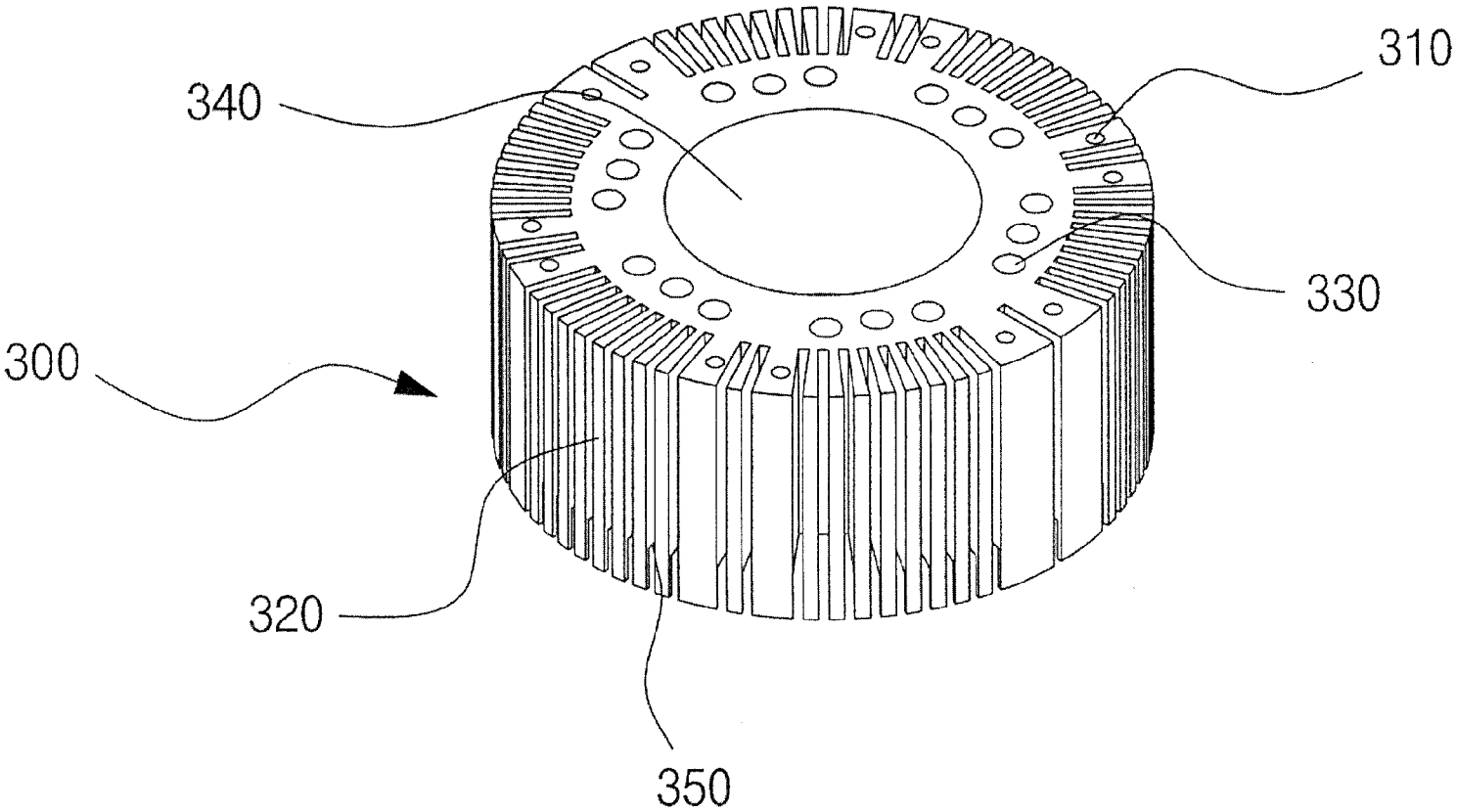
FIG. 5 is a perspective view illustrating the construction of a cooling block, which is an important element of the present invention.

FIG. 2*a* is a perspective view illustrating the construction of a bulb-type LED lighting apparatus embodied using the technology of the present invention. FIG. 2*b* is an exploded perspective view illustrating the construction of the bulb-type LED lighting apparatus embodied using the technology of the present invention. FIG. 3 is a longitudinal sectional view illustrating the construction of the bulb-type LED lighting apparatus embodied using the technology of the present invention. As shown in the drawings, the bulb-type LED lighting apparatus 1 of the present invention includes: a base unit 100 in which a screw base 130 is integrated with a housing 110 having a plurality of heat dissipating slits 120; and a heat dissipating space retaining unit 200 in which a spacer 220 is integrated with a surface of a plate 210 detachably mounted to the housing 110, with a plurality of spacer locking holes 220*a* formed through the heat dissipating space retaining unit 200.

A cooling block 300 is connected to the heat dissipating space retaining unit 200. The cooling block 300 has connection holes 310 and heat pipe fitting holes 330 for holding heat pipes, with an air exhausting through hole 340 formed through the center of the cooling block 300 and a plurality of heat dissipating fins 320 integrated with the cooling block 300.

Figure 6:
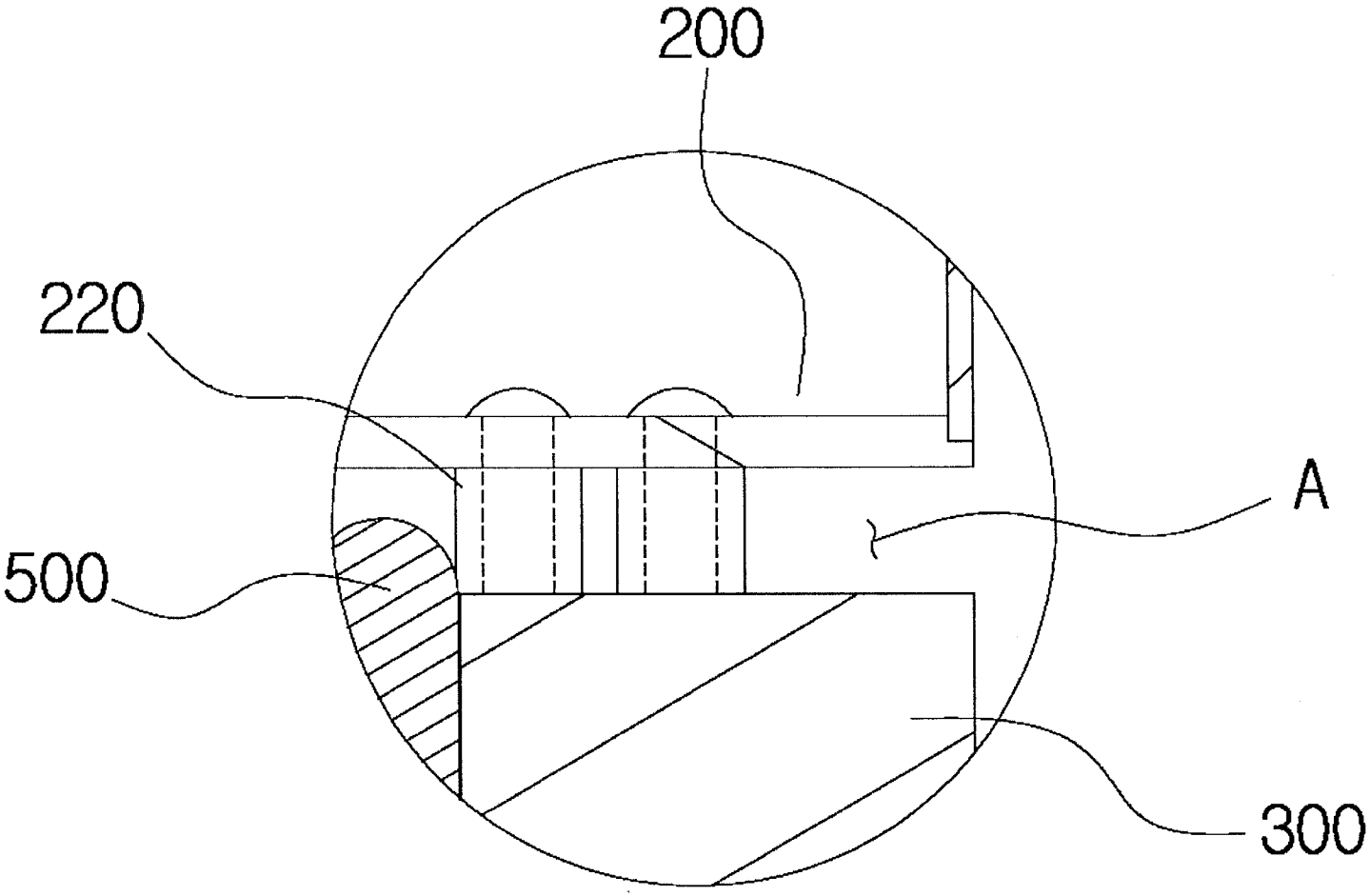
FIG. 6 is an enlarged sectional view illustrating the engagement structure of a heat dissipating space retaining unit and the cooling block, which are the important elements of the present invention.

As shown in FIGS. 3 and 6, to define a heat dissipating space A at a location between the heat dissipating space retaining unit 200 and the cooling block 300 so as to dissipate internal heat to the outside, the cooling block 300 may be spaced apart from the plate 210 by the spacer 220.

Figure 7:
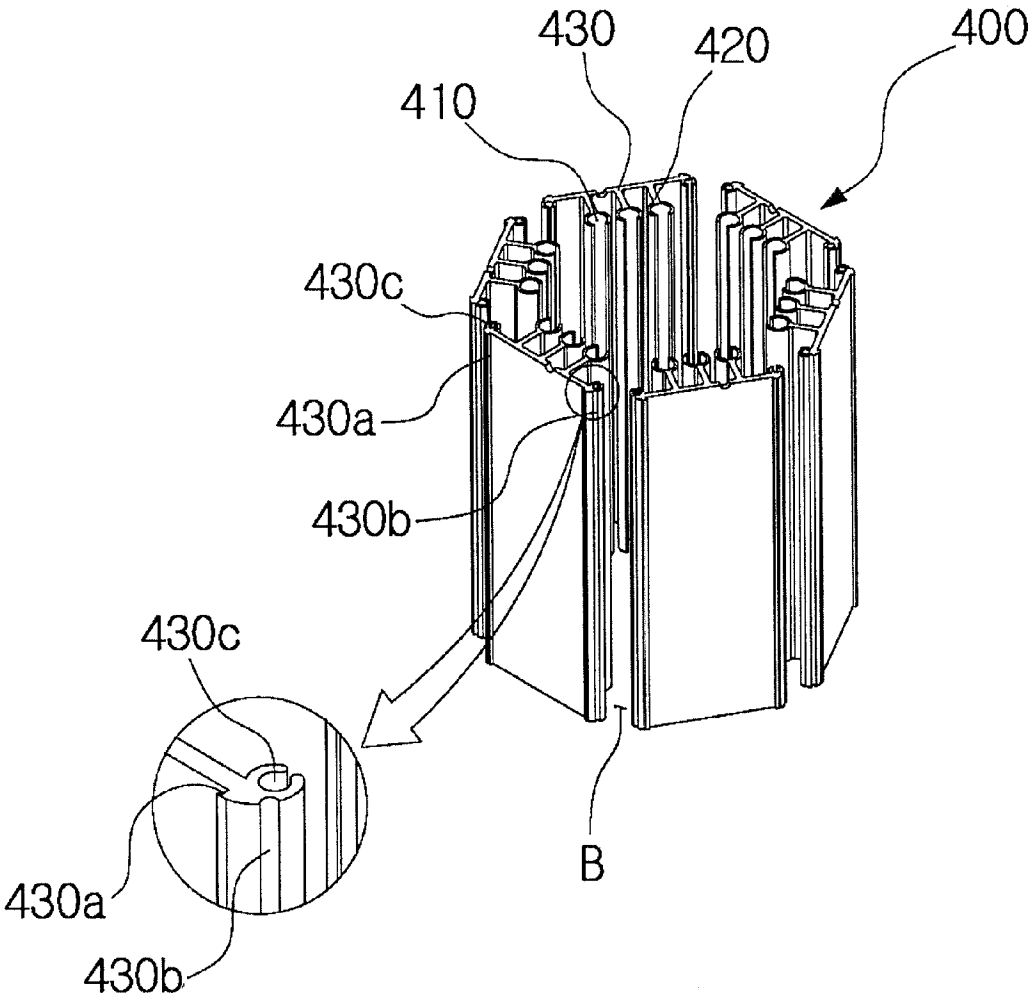
FIG. 7 is a perspective view illustrating the construction of the heat dissipating frame, which is an important element of the present invention.

As shown in FIG. 7, a heat dissipating frame 400 is connected to the cooling block 300. Here, the heat dissipating frame 400 includes heat exchanging plates 430 arranged at spaced positions such that the heat exchanging plates 430 form a cylindrical arrangement. To firmly hold the heat pipes 500, respective clip parts 410 are formed on ends of cooling fins 420 integrated with the heat exchanging plates 430 of the heat dissipating frame 400. Further, on one side of each of the heat exchanging plates 430 on which the cooling fins 420 are formed, screw locking holes 430*c* are formed on opposite side edges of the heat exchanging plate 430, and locking screws passing through the heat dissipating space retaining unit 200 are tightened to the screw locking holes 430*c*. On the other side of each of the heat exchanging plates 430 opposite to the cooling fins 420, cover locking slits 430*b* for locking a protective cover 700*a* are formed on the opposite side edges of the heat exchanging plate 430. Further, a circuit board seat 430*a* is formed on the outside surface of each heat exchanging plate 430 at a position between the cover locking slits 430*b*, so that a first LED circuit board 600*a* can be removably held in the circuit board seat 430*a*.

Figure 8:
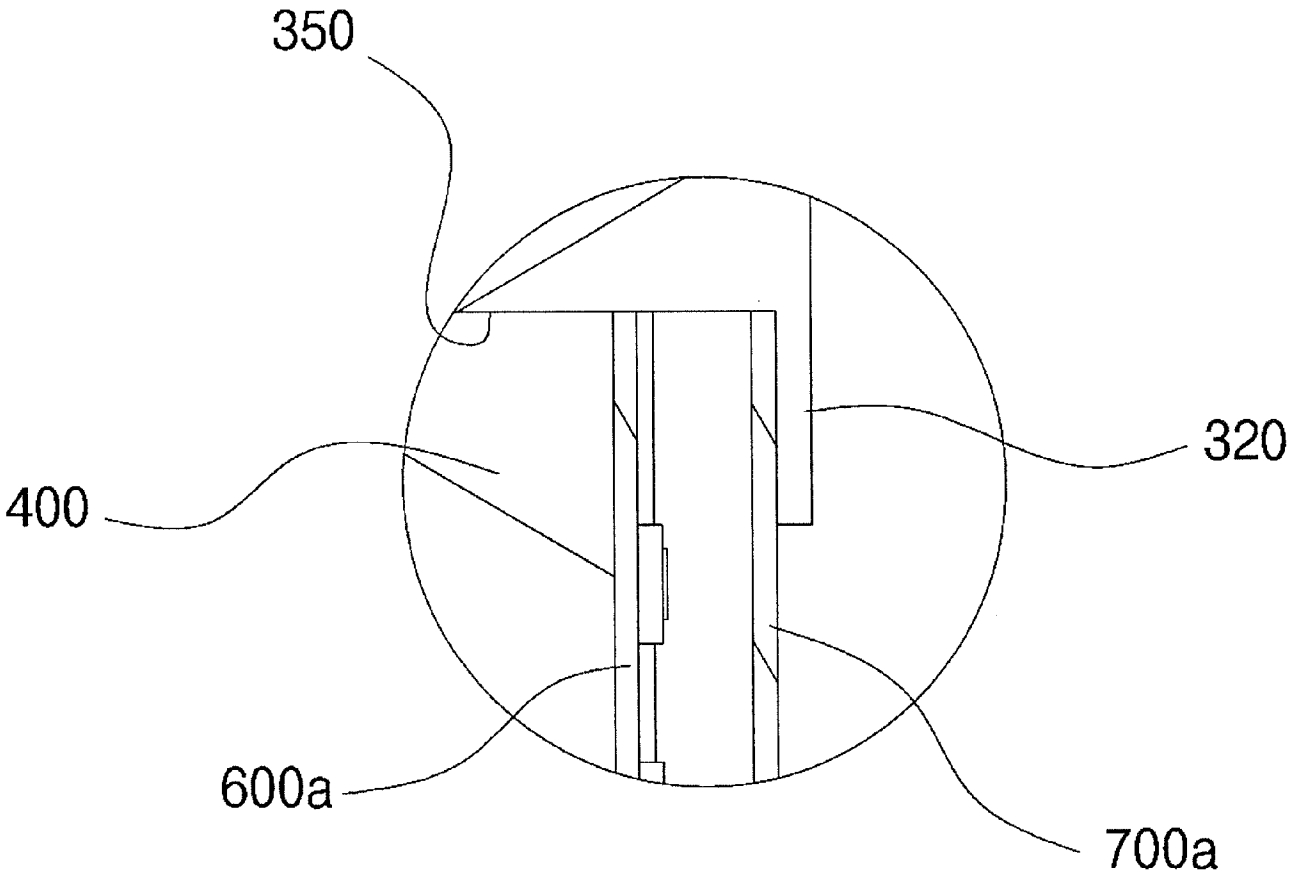
FIG. 8 is an enlarged sectional view illustrating the engagement structure of the cooling block and the heat dissipating frame, which are the important elements of the present invention.

As shown in FIG. 8, to increase the length of the cooling fins 320 constituting the cooling block 300, shoulders 350 extend downward from the lower ends of the respective cooling fins 320, thus forming a skirt. When assembling the elements of the lighting apparatus, the upper end of the heat dissipating frame 400 is fitted inside the skirt formed by the shoulders 350. Further, in the heat dissipating frame 400, convective circulation passages B are formed between the heat exchanging plates 430, so air inside and outside the heat dissipating frame 400 can efficiently circulate through the convective circulation passages B, thereby greatly increasing cooling efficiency.

Figure 9:
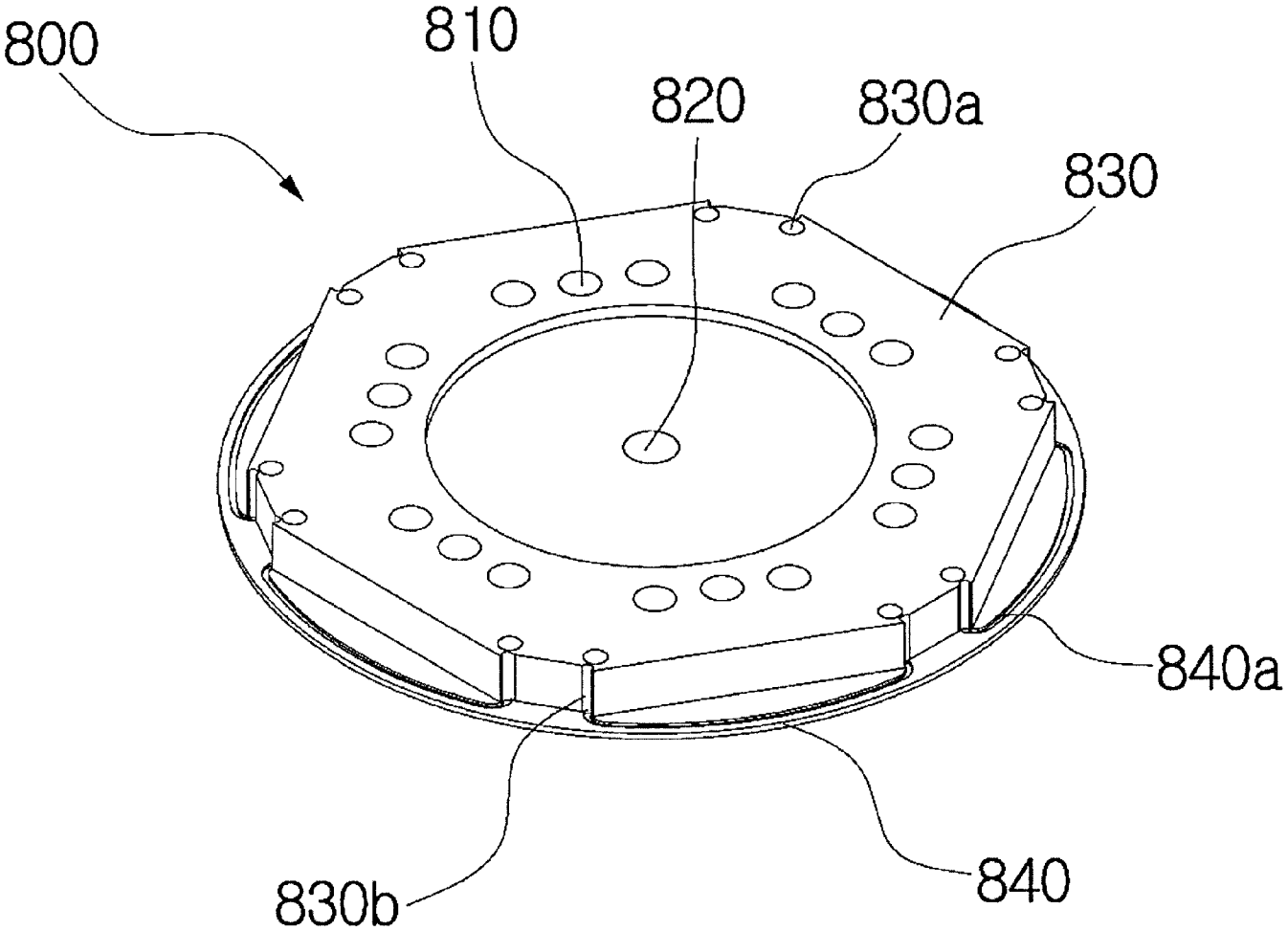
FIG. 9 is a perspective view illustrating the construction of a connection plate unit, which is an important element of the present invention.

As shown in FIG. 9, a connection plate unit 800 is mounted to the lower end of the heat dissipating frame 400. The connection plate unit 800 includes a connection plate body 830 provided with pipe fitting slots 810 for fitting the heat pipes and a central locking through hole 820 formed through the center of the connection plate body 830. The connection plate body 830 of the connection plate unit 800 further includes connection through holes 830*a* that are aligned with the screw locking holes 430*c* of the heat dissipating frame 400. In addition, cover locking slits 830*b* for fitting the protective covers 700*a* and shoulders 840 for supporting the protective covers 700*a* are formed on the connection plate body 830 of the connection plate unit 800.

To hold the lower ends of the protective covers 700*a*, the shoulders 840 of the connection plate unit 800 are provided with respective cover fitting slits 840*a*. The upper and lower ends of the heat pipes 500 are held by the heat pipe fitting holes 330 of the cooling block 300 and the pipe fitting slots 810 of the connection plate unit 800, and the middle portions of the heat pipes 500 are held by the clip parts 410 of the heat dissipating frame 400, so the heat pipes 500 transfer high temperature heat to the cooling block 300, the heat dissipating frame 400 and the connection plate unit 800 prior to dissipating heat to ambient air. The LED lighting apparatus further includes a plurality of first LED circuit boards 600*a* and a second LED circuit board 600*b*. The first LED circuit boards 600*a* are installed outside the heat dissipating frame 400, with LED modules mounted to the surfaces of the first LED circuit boards 600*a*. The second LED circuit board 600*b* has a locking through hole, with LED modules mounted to the surface of the second LED circuit board 600*b*. The locking through hole of the second LED circuit board 600*b* is formed through the center of the board 600*b* such that the locking through hole is aligned with the central locking through hole 820 of the connection plate unit 800. The LED lighting apparatus further includes protective covers 700*a* and 700*b* for protecting the first and second LED circuit boards 600*a* and 600*b* having the respective LED modules.

As shown in FIG. 6, the heat pipes 500 may be installed in the LED lighting apparatus such that the upper ends of the heat pipes 500 can protrude into the heat dissipating space A that is defined between the heat dissipating space retaining unit 200 and the cooling block 300 so as to dissipate internal heat to the outside. In the heat dissipating space A, the heat pipes 500 are in contact with ambient cold air, thereby dissipating high temperature heat to the ambient cold air. Thus, the heat pipes 500 can be efficiently cooled.

Figure 10:
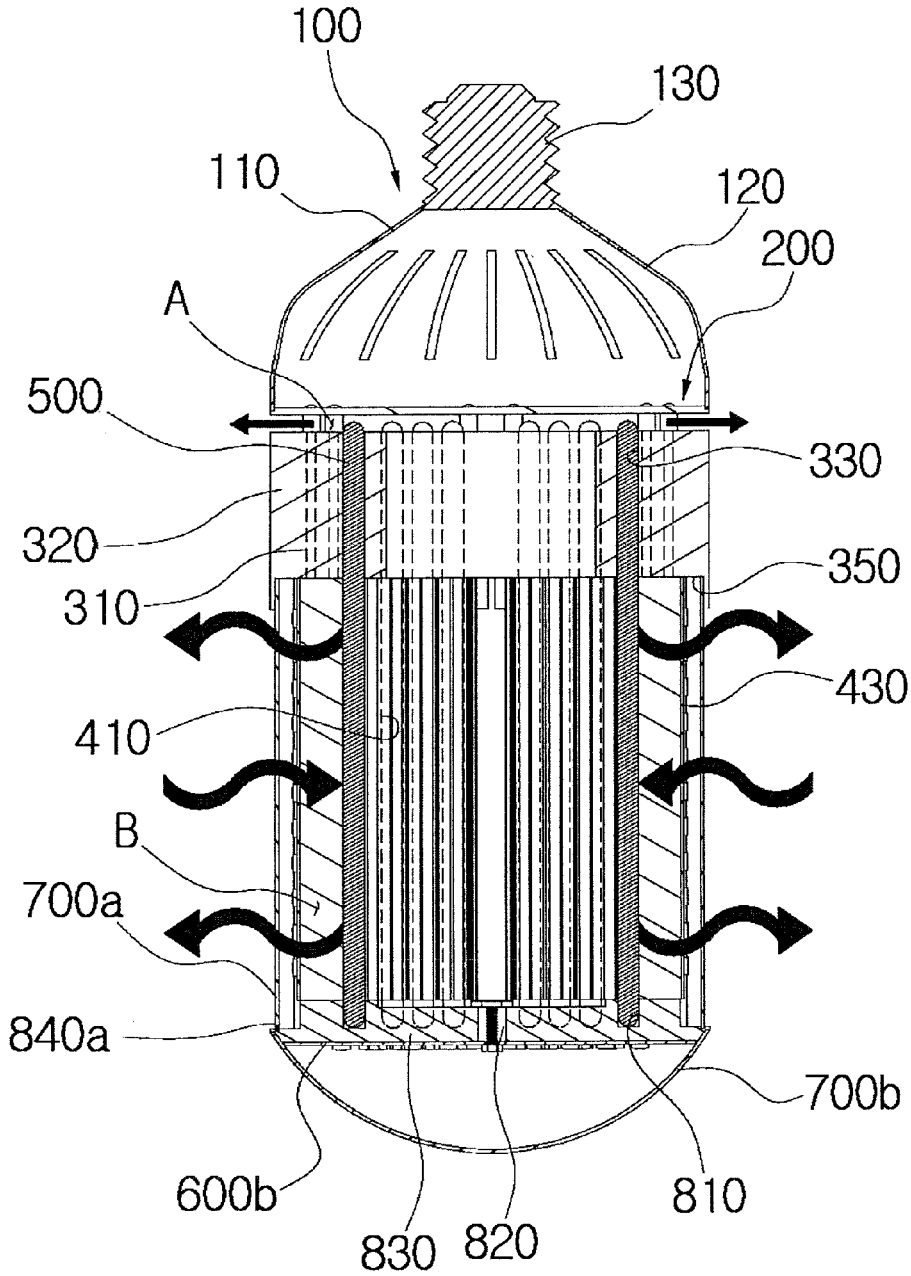
FIG. 10 is a sectional view illustrating the cooling operation of the bulb-type LED lighting apparatus of the present invention.

The bulb-type LED lighting apparatus having the above-mentioned construction of the present invention will be operated as follows. As shown in FIG. 10, when the LED lighting apparatus 1 is turned on by operating a switch (not shown), the LED modules of the first and second LED circuit boards 600*a* and 600*b* emit light, and heat is generated from the LED modules as time goes by.

The high temperature heat generated from the LED modules is transferred to the heat exchanging plates 430 of the heat dissipating frame 400. Here, the heat exchanging plates 430 of heat dissipating frame 400 according to the embodiment shown in the drawings are arranged to form a hexagonal arrangement for ease of description. In a conventional bulb-type LED lighting apparatus, the high temperature heat of the heat exchanging plates 430 may be transferred to air inside the space defined by the heat exchanging plates 430 of the heat dissipating frame 400, so the air inside the space of the heat dissipating frame 400 may reach a temperature of about 90° C.

However, in the present invention, the high temperature heat of the heat exchanging plates 430 is transferred to the cooling fins 420 integrated with the heat exchanging plates 430, and the heat of the cooling fins 420 is transferred to the heat pipes 500 held by the clip parts 410 of the cooling fins 420.

Here, a part of the heat generated from the LED modules is transferred to the heat pipes 500, and the remaining part of the heat is dissipated to air inside the space defined by the cooling fins 420 and the heat exchanging plates 430 of the heat dissipating frame 400.

The heat transferred to the heat pipes 500 heats a thermal medium charged in the heat pipes 500 and vaporizes the thermal medium. The vaporized thermal medium moves to the upper parts of the heat pipes 500. Here, as described above, the upper end of the heat pipes 500 are placed in the heat dissipating space A. Thus, in the heat dissipating space A, ambient cold air comes into contact with the heat pipes 500 heated by the thermal medium, thereby cooling the heat pipes 500.

Further, the heat inside the space defined within the heat dissipating frame 400 moves upward and is transferred to the cooling block 300. Here, the cooling block 300 removes the heat through an air cooling manner. Further, due to the heat dissipating space A defined between the heat dissipating space retaining unit 200 and the cooling block 300, the heat dissipation effect is further increased.

Further, heat is also dissipated to air in the convective circulation passage B defined between the heat exchanging plates 430 of the heat dissipating frame 400, so the present invention can maximize cooling effects and can prevent the LED circuit boards and the LED modules from malfunction due to overheating. In the present invention, the protective covers 700*a* are firmly held in the LED lighting apparatus in such a way that the side edges thereof are held by the cover locking slits 430*b* of the frame 400, the upper ends thereof are held by the cooling block 300, and the lower ends thereof are held by the cover fitting slits 840*a* of the connection plate unit 800, so the protective covers 700*a* can be retained in their positions and can efficiently protect the LED circuit boards and the LED modules.

As described above, in the bulb-type LED lighting apparatus of the present invention, the cooling fins 420 of the heat dissipating frame 400 are configured to perform a collateral function as a holding means for the heat pipes 500, so the present invention can realize an improved heat exchanging effect. Further, in the present invention, the heat dissipating frame 400 is formed by assembling the plurality of heat exchanging plates, with the convective circulation passages B defined between the heat exchanging plates, thereby allowing air to circulate convectively between the heat exchanging plates of the heat dissipating frame 400 and realizing efficient circulation of air between the inside and outside of the heat dissipating frame 400 through the convective circulation passages B, so the present invention can reduce the temperature inside the space defined within the heat dissipating frame 400 to about 30-50° C., thereby greatly increasing cooling efficiency and realizing an improvement in the expected life span and operational reliability of products.

The invention claimed is:

1. A bulb-type LED lighting apparatus, comprising:

a base unit in which a screw base is integrated with a housing having a plurality of heat dissipating slits;

a heat dissipating space retaining unit in which a spacer is integrated with a surface of a plate detachably mounted to the housing, with a plurality of spacer locking holes formed through the heat dissipating space retaining unit;

a cooling block connected to the heat dissipating space retaining unit and having connection holes and heat pipe fitting holes, with an air exhausting through hole formed through a center of the cooling block and a plurality of heat dissipating fins integrated with the cooling block;

a first LED circuit board having LED modules;

a heat dissipating frame including: heat exchanging plates arranged at spaced positions to form a cylindrical arrangement; clip parts formed on ends of cooling fins integrated with the heat exchanging plates; screw locking holes formed on opposite side edges of each of the heat exchanging plates on one side of the heat exchanging plate on which the cooling tins are formed, so locking screws passing through the heat dissipating space retaining unit are tightened to the screw locking holes; cover locking slits for locking a protective cover, the cover locking slits being formed on the opposite side edges of each of the heat exchanging plates on another side of the heat exchanging plate opposite to the cooling fins; and a circuit board seat formed on an outside surface of each of the heat exchanging plates at a position between the cover locking slits so that the first LED circuit board is removably held in the circuit board seat;

a connection plate unit comprising a connection plate body, the connection plate body including: pipe fitting slots; a central locking through hole formed through a center of the connection plate body; connection through holes formed through the connection plate body such that the connection through holes are aligned with the screw locking holes of the heat dissipating frame; cover locking slits for fitting the protective covers; and shoulders for supporting the protective covers;

a second LED circuit board having a locking through hole aligned with the central locking through hole of the connection plate unit, with LED modules mounted to a surface of the second LED circuit board; and convective circulation passages defined between the heat exchanging plates of the heat dissipating frame so as to show air to circulate between the heat exchanging plates and realize circulation of air between inside and outside of the heat dissipating frame through the convective circulation passages.

2. The bulb-type LED lighting apparatus of claim 1, wherein a heat dissipating space is defined between the heat dissipating space retaining unit and the cooling block so as to dissipate internal heat to outside.

3. The bulb-type LED lighting apparatus of claim 1, wherein the shoulders of the connection plate unit further include cover fitting slits for holding the protective covers.

4. The bulb-type LED lighting apparatus of claim 1, wherein shoulders extend downward from lower ends of the respective cooling fins of the cooling block, so a length of the cooling fins is increased and an upper end of the heat dissipating frame is fitted inside a skirt formed by the shoulders of the cooling fins.

5. The bulb-type LED lighting apparatus of claim 1, further comprising: heat pipes of which upper and lower ends are held by the heat pipe fitting holes of the cooling block and the pipe fitting slots of the connection plate unit, and middle portions are held by the clip parts of the heat dissipating frame, so the heat pipes perform heat exchanging.

6. The bulb-type LED lighting apparatus of claim 5, wherein the heat pipes are installed such that the upper ends of the heat pipes protrude into a heat dissipating space that is defined between the heat dissipating space retaining unit and the cooling block so as to dissipate internal heat to outside.

* * * * *